US007997110B2

(12) United States Patent
Carter et al.

(10) Patent No.: US 7,997,110 B2
(45) Date of Patent: Aug. 16, 2011

(54) CLEANING DIES FOR HOT FORMING OF ALUMINUM SHEETS

(75) Inventors: Jon T. Carter, Farmington, MI (US); Paul E. Krajewski, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 377 days.

(21) Appl. No.: 12/362,611

(22) Filed: Jan. 30, 2009

(65) Prior Publication Data

US 2010/0192655 A1 Aug. 5, 2010

(51) Int. Cl.
*B21C 43/00* (2006.01)
*B21B 45/02* (2006.01)

(52) U.S. Cl. ..... 72/40; 72/41; 72/43; 72/45; 72/53; 451/38; 451/39; 451/41

(58) Field of Classification Search ..... 72/39, 40, 72/41, 42, 43, 44, 45, 53; 451/38, 39, 40
See application file for complete search history.

(56) References Cited

U.S. PATENT DOCUMENTS

| | | | | |
|---|---|---|---|---|
| 4,998,428 | A * | 3/1991 | Rechenbach | 72/40 |
| 6,450,396 | B1 | 9/2002 | Krajewski | |
| 6,516,645 | B2 | 2/2003 | Morales et al. | |
| 7,156,926 | B2 * | 1/2007 | Voges | 72/40 |
| 2010/0192655 | A1 * | 8/2010 | Carter et al. | 72/40 |

* cited by examiner

*Primary Examiner* — David B Jones
(74) *Attorney, Agent, or Firm* — Reising Ethington P.C.

(57) ABSTRACT

In substantial volume production operations involving hot blow forming or hot stamping of aluminum alloy sheet workpieces, debris largely comprised of particles of aluminum alloy material adheres to critical forming surfaces of the heated steel tools. This debris mars forming surfaces and causes defects in aluminum alloy parts formed against them. Such aluminum-rich debris may be reactively transformed to change its adherent properties and removed from tool surfaces without removing the heated tool from production. In one embodiment, a hot sacrificial magnesium sheet may be formed on the tool(s) to alloy with aluminum debris and carry it from the forming surface.

12 Claims, 3 Drawing Sheets

CLEANING DIES FOR HOT FORMING OF ALUMINUM SHEETS

TECHNICAL FIELD

This invention pertains to the hot forming of aluminum alloy sheet workpieces. More specifically, this invention pertains to practices for removal of aluminum particles that accumulate on hot steel dies used in production of hot formed aluminum alloy sheet metal articles.

BACKGROUND OF THE INVENTION

Suitable sheet metal aluminum alloys may be formed at elevated temperatures by hot blow forming, hot stamping, or the like into intricate three-dimensional shapes. Often the formed articles are inner and/or outer closure panels for automotive vehicles. In each of these elevated temperature processes, a preheated aluminum alloy sheet is formed between opposing forming dies carried on platens of a hydraulic press. The forming surfaces of the forming dies are typically machined from cast blocks of a suitable tool steel alloy. And the forming surfaces of a die are finished (e.g. polished) to a very smooth finish, especially where the surface of the part must present an attractive finish to a user.

In hot blow forming, a highly formable aluminum alloy sheet (e.g., AA5083) is heated (at e.g., about 500° C.) and gripped at peripheral edges between complementary opposing dies. Pressurized air or other fluid is applied against one side of the sheet to stretch it into conformance with the forming surface of one die. The opposing die provides an air chamber on the pressurized side of the aluminum sheet. Both dies may be heated to elevated forming temperatures to maintain the sheet at a predetermined forming temperature for shaping of the sheet. The sheet may first be pressed against one die for pre-shaping, and then blown against the opposing die for finish shaping. Thus, at least one surface of the hot sheet is stretched against and over the forming surface of a die.

In production operations, heated sheet workpieces are repeatedly placed on the press, formed on the heated die(s), and removed. A lubricant, such as boron nitride, is applied to the sheets to buffer the repeated sliding, frictional contact. But, particularly in regions such as die radii where local pressures will be high, the aluminum will locally weld to the die creating small patches of aluminum on the die. These small patches, once formed, promote additional die-aluminum interaction and will, as more aluminum sheets are processed, grow to relatively large, layered particles of, primarily, aluminum but also incorporating aluminum oxide and boron nitride which adhere to the die surface. Within any given high pressure region, the particles may be formed and may vary in size; but a typical aluminum alloy particle may, for example, have dimensions in the 100 to 200 micron range. This die-adhering debris causes indentations, scratches and other defects in formed parts. In many hot formed parts the surfaces will be visible to users and surface defects like this cannot be tolerated.

The hot stamping of aluminum alloy sheet materials typically uses different aluminum alloys. Somewhat lower forming temperatures than in hot blow forming may be employed (for example, 300° C. to about 400° C.). And the heated dies are configured so that one die pushes the heated metal against an opposing die. But again dry lubrication material and aluminum fragments from the sheet metal workpieces combine to form die-adherent debris on the dies which must be removed.

U.S. Pat. No. 6,516,645, titled Hot Die Cleaning for Superplastic and Quick Plastic Forming," describes the use of solid carbon dioxide pellets for removal of dried lubricant, such as boron nitride, from hot die surfaces. Sheet forming production is interrupted and an air stream carrying the pellets is systematically directed over and against the forming surfaces of the die or dies. The impact of air, carbon dioxide, and $CO_2$ pellets (from which carbon dioxide gas is subliming) impinging on the surfaces sweeps away lubricant material in a clean and efficient manner that does not damage the hot die surfaces. But this cleaning method does not effectively remove aluminum metal particles or debris from the die surfaces. It has been necessary to remove the dies from service, allow them to cool, and to scrape the aluminum debris from the surfaces, using manual polishing and grinding. Often the forming surfaces required further polishing before they could be returned to production use.

A practice is needed for removal of aluminum metal particles from hot die surfaces without prolonged interruptions of production of formed parts.

SUMMARY OF THE INVENTION

This invention provides some practices for reactively transforming, for example by oxidation, aluminum particles adhering to the forming surface of a hot die or other forming tool. The dies maybe used in hot blow forming or warm stamping of aluminum alloy sheet metal blanks. The oxidation is conducted so as to convert the slivers or particles of aluminum material to a consistency that permits easier removal from the hot tool surface to which they are attached. The oxidation process may be conducted while the die is still in its forming press or other operative machine and while at the operative temperature.

In one embodiment of the invention the progressive introduction of aluminum alloy sheet blanks between the hot forming dies is interrupted by the substitution of a bare magnesium alloy sheet blank. The sacrificial magnesium alloy sheet is heated and shaped by the hot, aluminum-particle-containing forming tools. Contact between die surfaces and the hot magnesium material is maintained for a suitable time for the aluminum particles to react with, or inter-diffuse with the magnesium sheet. The aluminum particles may be alloyed with the magnesium sheet material to form a relatively low-melting material that oxidizes in the hot and air-containing environment of the press. When the formed magnesium is removed from the dies and discarded, the aluminum derived from the particles is carried out with the sacrificed sheet. Any residual aluminum material may be blown out of the die with air or the above described $CO_2$ cleaning cycle.

In blow forming it is essential that no rupture occurs in the sheet. Clearly, the production aluminum sheets will not be subject to rupture but the less ductile sacrificial sheet may. If this occurred, the cleaning process just described would be terminated prematurely and might thus be rendered ineffective. This difficulty may be overcome in a second variant of the first embodiment by supporting the magnesium sheet on a carrier sheet of aluminum. It would further require that appropriate steps be taken to isolate the magnesium blank from the aluminum carrier sheet to prevent their reacting with one another. This could be accomplished by heavily coating the aluminum sheet with boron nitride lubricant or by anodizing the aluminum sheet.

In a second embodiment of the practice of the invention, an oxidizing material for oxidation of the adherent aluminum particles is applied to the hot die surfaces. Again, the material is selected to initiate oxidation of aluminum particles to a consistency for easy removal from the die. The oxidizer may be, for example, ammonium perchlorate, or iron oxide, or an oxidizing gas such as an oxygen/air mixture. The application of the oxidizer substance may be supplemented with mechanical brushing for removal of oxidized aluminum material. In another embodiment of the invention the surface of the die may be blasted with iron oxide particles for oxidation of adhering aluminum particles.

In still another embodiment of the invention the combination of an electric arc (applied at a controlled gap from the tool surface) and a process gas are used to oxidize aluminum particles and melt, or vaporize, or ablate oxidized aluminum material from the forming surfaces of a one or more dies.

In each of the above oxidation practices the oxidation treatment may be preceded by a cleaning process, such as the $CO_2$ cleaning process for removal of unwanted lubricant and other debris susceptible to such cleaning process. And in many instances it may be desired to follow an oxidation treatment with the $CO_2$ process, or the like, to remove oxidized adherent aluminum material.

As stated, a goal of the oxidation process in treating hot die surfaces is to remove adherent aluminum alloy particles with less interruption of the use of the tools in hot forming of aluminum alloy sheet products.

Other objects and advantages of the invention will be apparent from a detailed description of illustrative practices for oxidation of aluminum particles and removal from hot die surfaces.

DESCRIPTION OF PREFERRED EMBODIMENTS

Figure 1:
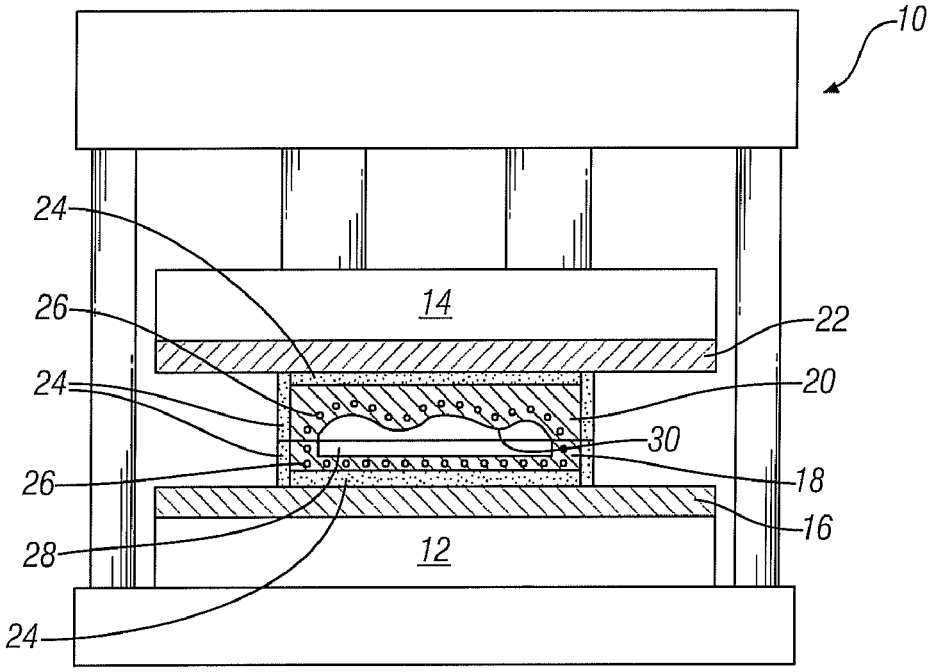
FIG. 1 is a schematic elevation view of representative heated tools for hot blow forming of aluminum alloy sheet blanks. The tools are made of a tool steel alloy and internally heated to forming temperatures. Forming surfaces of such tools may be cleaned of aluminum alloy debris by practices of this invention.

FIG. 1 illustrates a hydraulic press 10 for hot blow forming of aluminum alloy sheet workpieces into useful articles such as automotive vehicle closure panels. For example inner and/or outer lift gate panels or door panels may be made.

Hydraulic press 10 comprises a stationery lower platen 12 and a vertically movable upper platen 14. A layer of thermal insulation 16 is placed on lower platen 12 and an internally heated lower hot blow forming tool 18 (shown in cross-section) is located on thermal insulation 16. Similarly, movable upper platen 14 carries an internally heated upper forming tool 20 (shown in cross-section) that is thermally separated from upper platen 14 by a layer of thermal insulation 22.

The forming tools 18, 20 are formed of a suitable tool steel, for example, P20, a chromium, molybdenum tool steel with, typically, 0.35 percent by weight of carbon. The bases and sides of each forming tool 18, 20 are covered with thermal insulation (indicated generally with numeral 24). Each forming tool 18, 20 is heated with a suitable number of electrical resistance heating rods (e.g., 26) placed to maintain the tools and forming surfaces at suitable hot blow forming temperatures, which may be about 500° C.

In this illustration lower forming tool 18 is shaped to provide a high pressure air chamber 28 for applying a scheduled program of varying forming pressures against one side of a preheated aluminum alloy sheet blank (not shown in the figure). Upper tool is machined and polished to present a forming surface 30 for a succession of many aluminum alloy sheet metal workpieces. In sheet metal forming operations, press 10 is actuated by means (not illustrated) to lift upper forming tool 20 for placement (often by a robot) of a preheated aluminum alloy sheet (also at about 500° C.) between the tools 18, 20. Tool 20 is lowered to grip the edges of the sheet workpiece between the sealing beads (not shown) on the sides of the tools. Fluid (often air) is then introduced into chamber 28 in accordance with a pressure schedule to progressively stretch the sheet into compliant contact with surface 30 of tool 20. After a period of minutes the upper tool 20 is raised for careful removal of the hot stretch formed part.

As described above, pieces of aluminum gradually come off the workpieces and adhere, for example, to surface 30 of forming tool 20. The need arises to remove such debris from tool surfaces; hopefully, without removal of the tool from its press environment.

Current practice in hot blow forming (and many warm stamping operations) often includes spraying each aluminum blank with boron nitride (BN). The boron nitride lubricates the interface between the blank and forming surface to facilitate metal flow over a die surface, facilitate part release from a die surface, and generally prevent metal workpiece-to-metal tool contact. Such coating with BN yields much better results than with un-lubricated aluminum, but does not avoid adhesion of some aluminum particles to the steel dies. These particles lead to scratches on subsequent panels which are sanded out in an expensive metal-finishing operation. Periodically the massive dies are removed from the press, allowed to cool to room temperature, then manually ground/polished to remove adhering aluminum before being put back into production. Practices of this invention reduce the need for cooling the tools to room temperature to remove aluminum particles. This increases output of formed aluminum alloy sheet metal products, improves sheet metal product quality and reduces costs.

In one embodiment of the invention an oxidation process would involve periodically forming a bare magnesium alloy blank in a hot forming process similar to that used to the one used to hot blow form aluminum alloy panels. This die surface cleaning step would be performed when it is observed that aluminum particles adhering to the hot forming tool surface are marring the surface of formed aluminum sheet metal parts. The heated forming tools remain in the forming press but the delivery of aluminum sheet blanks is temporarily interrupted for this die surface cleaning procedure. The adherent Al particles are removed by reaction with a preheated magnesium sheet as it is inserted and formed between the tools. The aluminum particles adhering to the tool surface (s) may either (a) become alloyed with the magnesium sheet and be carried from the die with the magnesium sheet or (b) form a low melting point intermetallic which quickly oxidizes and can be blown out of the die. This practice is illustrated schematically in FIGS. 2A-2D.

Figure 2A:
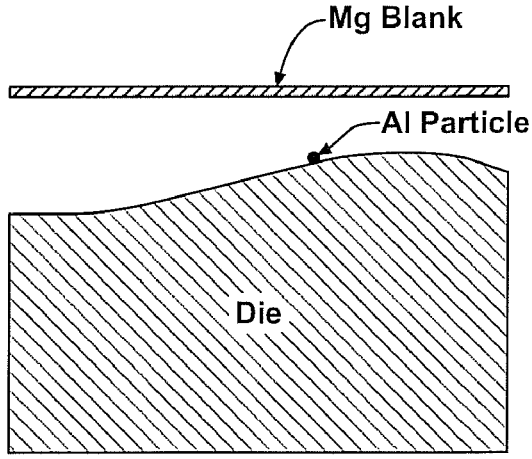
FIGS. 2A-2D are a schematic illustration of a four-step sequence for removal of an aluminum particle from a forming surface of a tool steel die using a sacrificial magnesium sheet.
Figure 2B:
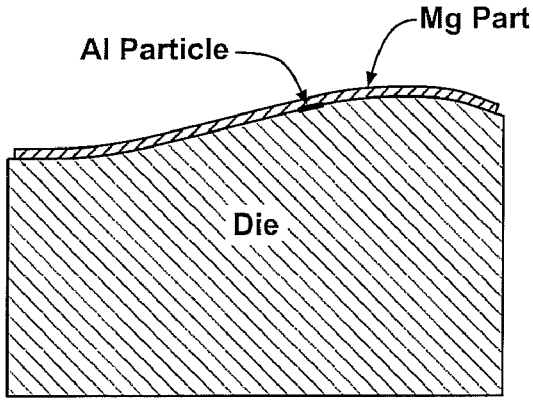
Figure 2C:
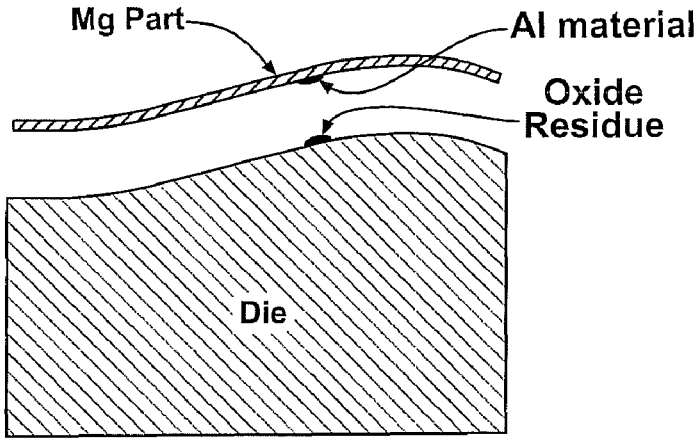
Figure 2D:
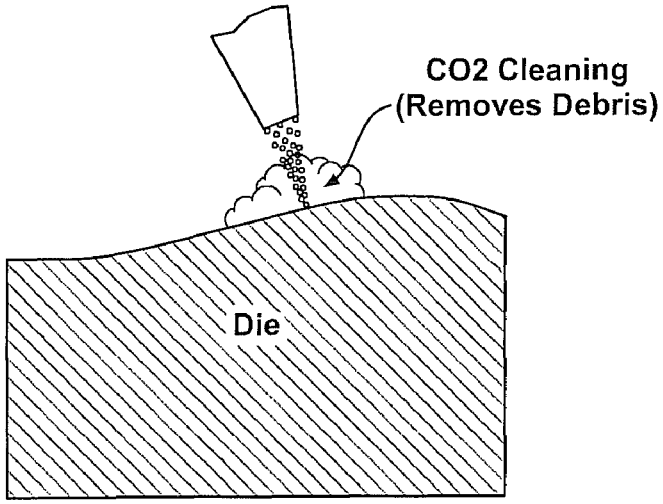

As an example, a three step procedure may be followed that comprises a $CO_2$ cleaning cycle (including dry ice pellets) to remove any BN buildup on the hot forming tool surface tool (This step is not illustrated). Following this pre-cleaning with $CO_2$, a forming cycle is conducted with a hot Mg blank which may have no lubricant but contacts debris-laden surfaces of the forming tool. The die surface with an adherent aluminum particle and overlying magnesium sheet is illustrated in FIG. 2A and the formed magnesium sheet on the die surface overlying a magnesium particle is illustrated in FIG. 2B. The forming cycle (conducted, e.g., with the forming surfaces and magnesium blank at about 500° C.) may be slightly slower than the production cycle for aluminum and may include an extra dwell at the end of the cycle to make sure the diffusion and subsequent oxidation reaction has occurred. The Mg panel with reacted aluminum material is then removed from the die as illustrated in FIG. 2C. Another $CO_2$ cleaning cycle may be run to remove any oxide or other debris which formed during the reaction and may remain in the tool (FIG. 2D). This aluminum particle removing cycle could be repeated with a new magnesium alloy blank, if needed.

The exact procedure and micro-mechanism of cleaning could be changed to suit the nature of the adhering Al particles, based on, for example their: size, oxide content, BN content, etc. The preheat temperature of the magnesium sheet may be somewhat adjusted as desired to promote solid-state reactions with aluminum alloy particles or to form liquid reaction products which could (a) react with air in the die cavity to form a solid oxide or (b) form a brittle intermetallic compound. Remnants of either solid phase could be removed by blasting with dry ice particles. If oxides present in the adhering aluminum particles hinder the cleaning process, fluxing agents (salts) may be applied to liquefy them.

In another aluminum chip oxidation embodiment, a particle-containing mixture of oxidizing materials is applied to the hot forming tool surface. The mixture comprises particles of an oxidizer (ex. ammonium perchlorate), a catalyst (ex. iron oxide), and other ingredients such as a high temperature resistant carrier. The oxidizing mixture is designed to initiate and sustain chemical reactions with the aluminum alloy particles to alter their hardness or consistency to facilitate their removal from the tool surface. Simultaneously, or shortly thereafter, the oxidation particles and reacted aluminum alloy particles would be aggressively rubbed with a wire brush or metal wool or metal felt. The combined action of the applied mixture, the elevated temperature of the die, and the rubbing, serve to oxidize the aluminum and fragment the resulting oxide. In another embodiment, an oxygen-rich gas would be used instead of, or in addition to, the solid mixture. As described above, supplemental cleaning methods, such as blasting with dry ice, may be used before and after this aluminum fragment oxidation process to help remove BN and oxide layers.

Another oxidation process comprises the use of a cleaning head which may be mounted on a robot arm or other mechanical actuator for the purpose of moving over the surface of a hot steel die and removing adhering aluminum-rich particles. The working face of the cleaning head would have one or more electrodes near the center, and glide pads around the periphery to establish a fixed gap between the electrodes and the die surface. The oxidizing head may also have a nozzle for supplying a process gas into the gap, and a vacuum port for removing debris. In practice, an appropriately controlled power supply would be attached to the die and to the head electrodes so that a high voltage may be established in the gap. Since the head is positioned at a fixed distance from the die surface, whenever the moving head crosses over an aluminum particle, the gap size is reduced, and a spark discharge occurs. The associated heating melts and/or vaporizes the aluminum metal, and ablates entrapped oxides and nitrides. The exact nature of the spark and its effects on the aluminum-rich particles will be determined by the settings of the power supply (e.g., AC or DC, straight or reverse polarity, pulse shape, etc.) and the gas environment (flow rate, turbulence, oxidizing potential, etc.). In one embodiment, the aluminum vapors and ablated micro-droplets would be oxidized by the process gas and removed by the vacuum line. Blasting of the die surface with dry ice pellets before and/or after the oxidative spark cleaning process may complement the aluminum particle removing process.

In still another embodiment a combination of oxidation and bead blasting is use to remove adherent aluminum-rich particles from hot steel dies surfaces. Contaminated areas of a die surface may be blasted with beads formed of iron oxide, for example $Fe_2O_3$. Upon impact with a hot aluminum-containing particle an iron oxide bead reacts locally to oxidize aluminum and reduce the iron oxide. The reaction products are typically carried away by the blasting process. The oxidation reaction often produces a flash of light which may be used to indicate areas of the die surface that are most contaminated. And the absence of light flashes may indicate cleaning progress. This iron oxide oxidation process may be modified by coating iron oxide particles on the tool surface and blasting the coating with beads of metal, glass, or dry ice.

Figure 3A:
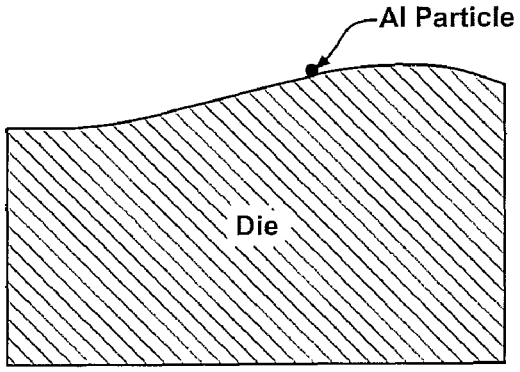
FIGS. 3A-3D are a schematic illustration of a four-step sequence for removal of an aluminum particle from a forming surface of a tool steel die using an iron oxide bead blast.
Figure 3B:
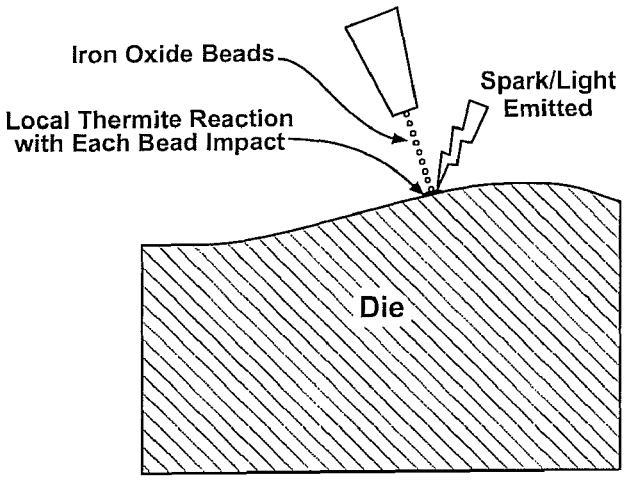
Figure 3C:
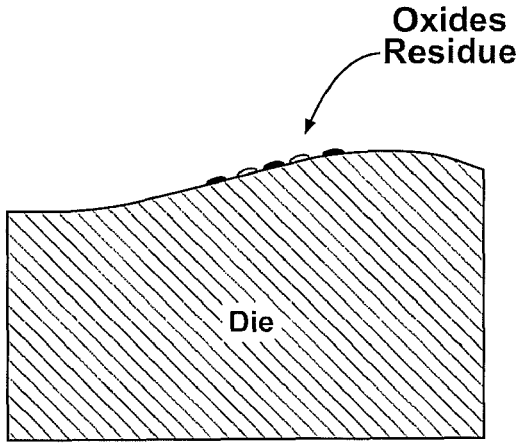
Figure 3D:
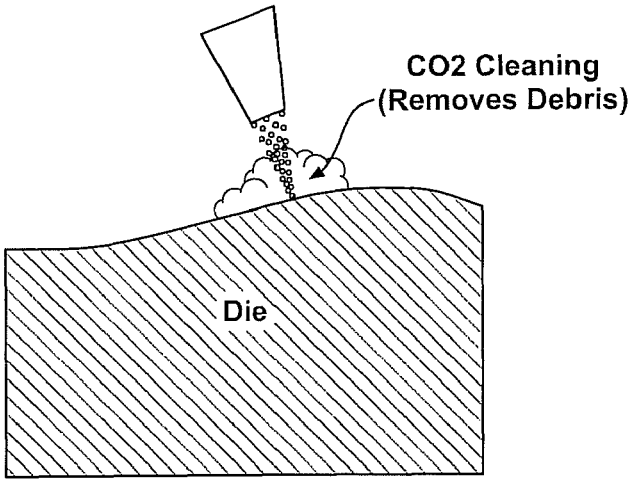

FIGS. 3A-3D schematically illustrate a practice of blasting a forming die surface with iron oxide beads to remove aluminum particles from the tool steel surface. FIG. 3A illustrates a problematic aluminum particle adhering to the hot steel surface of the heated die (for example at 300° C. to about 500° C.) depending on the hot forming process. In FIG. 3B a stream of iron oxide particles is directed at the hot aluminum particle so that some iron oxide beads strike the aluminum particle. A spark is emitted and an oxide residue is formed (FIG. 2C). The blast with iron oxide beads may remove the residue. But the bead blasting step may be followed with carbon dioxide/dry ice cleaning (FIG. 3D) as described above in this specification.

Thus, a variety of methods have been disclosed for reactive transformation of aluminum-rich particles adhering to a heated steel forming tool surface. Variations and combinations may be devised for reacting or oxidizing and removing aluminum particles of different compositions and shapes from different tool surfaces.

The invention claimed is:

1. A method of successively forming a series of heated aluminum alloy sheets with improved visible surfaces by deforming them, one after another, against one or more heated steel forming surfaces of a heated forming tool carried in a forming machine, where, from time to time, particles of aluminum alloy material from the aluminum sheets adhere to a steel forming surface and mar surfaces of subsequently formed aluminum alloy sheets; the method comprising:

periodically inspecting the heated steel forming surface for adhering aluminum particles and determining when it is necessary to remove such adhering particles, and then, without cooling or removal of the heated forming tool from the forming machine;

chemically transforming the particles of aluminum alloy material adhering to the heated steel forming surface to an altered composition in which they may be removed from the heated steel forming surface;

removing the transformed particles from the steel forming surface; and, thereafter, continuing the forming of aluminum alloy sheets against the steel forming surface.

2. A method as recited in claim 1 in which the steel forming surface is heated to a temperature in the range of about 300° C. to about 500° C.

3. A method as recited in claim 1 in which a heated magnesium sheet is deformed against the aluminum particles adhering to the heated steel forming surface to transfer aluminum-containing material to the deformed magnesium sheet; and removing the magnesium sheet with transferred aluminum-containing material from the heated steel forming surface.

4. A method as recited in claim 3 in which the steel forming surface is heated to a temperature in the range of about 300° C. to about 500° C. and the magnesium sheet is heated to a predetermined temperature in that temperature range for interaction with aluminum particles adhering to the steel forming surface.

5. A method as recited in claim 1 in which the adherent aluminum particles are chemically transformed by application of a particulate or gaseous oxidizing material to the heated steel forming surface.

6. A method as recited in claim 5 in which the adherent aluminum particles are chemically transformed by directing a stream of iron oxide particles against the aluminum particles.

7. A method as recited in claim 1 in which the aluminum particles are chemically transformed by application of an electric arc to the particles and heated forming surface.

8. A method as recited in claim 1 in which surfaces of the heated aluminum alloy sheets to be formed are coated with a film of lubricant for lubricated contact of the sheet surfaces with the heated steel forming surface.

9. A method as recited in claim 1 in which surfaces of the heated aluminum alloy sheets to be formed are coated with a film of boron nitride-containing lubricant for lubricated contact of the sheet surfaces with the heated steel forming surface.

10. A method as recited in claim 8 in which a stream of carbon dioxide pellets is directed against the steel forming surface for removal of ally residual lubricant residue before chemically transforming the aluminum particles.

11. A method as recited in claim 9 in which a stream of carbon dioxide pellets is directed against the steel forming surface for removal of any residual lubricant residue before chemically transforming the aluminum particles.

12. A method as recited in claim 1 in which chemically transformed aluminum particles are removed from the steel forming surface by applying a stream of carbon dioxide pellets against the steel forming surface and the chemically transformed particles.

* * * * *